US006637862B2

(12) United States Patent
Cahill et al.

(10) Patent No.: US 6,637,862 B2
(45) Date of Patent: Oct. 28, 2003

(54) MAINTENANCE MODULE FOR FLUID JET DEVICE

(75) Inventors: Clifford J. Cahill, Sharon, CT (US); Ha V. Duong, Litchfield, CT (US); Bopta Ky, Danbury, CT (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/071,300

(22) Filed: Feb. 8, 2002

(65) Prior Publication Data

US 2003/0151644 A1 Aug. 14, 2003

(51) Int. Cl.[7] ..... B41J 2/135
(52) U.S. Cl. ..... 347/44
(58) Field of Search ..... 347/44, 45–47, 347/75, 30, 85, 40; 346/47

(56) References Cited

U.S. PATENT DOCUMENTS 4,284,993 A * 8/1981 Kakeno ..... 347/85
4,827,287 A * 5/1989 Braun et al. ..... 347/75
6,347,859 B1 * 2/2002 Kawakami et al. ..... 347/40

* cited by examiner

*Primary Examiner*—Lamson Nguyen
*Assistant Examiner*—K. Feggins
(74) *Attorney, Agent, or Firm*—Donald J. Breh; Mark W. Croll; Welsh & Katz, Ltd.

(57) ABSTRACT

A maintenance module for a fluid jet device includes a first plate and a second plate affixed to the first plate. The first and second plates each define a longitudinal axis and a transverse axis perpendicular to the longitudinal axis. The first plate has a plurality of orifices formed therein extending parallel to the longitudinal axis inwardly of longitudinal edges. The first plate includes a vacuum opening formed therein at about a transverse edge of the first plate. The vacuum opening is formed perpendicular to a plane defined by the longitudinal and transverse axes. The second plate has an elongated channel extending over the first plate orifices so that the orifices are exposed through the channel. The channel is defined by opposing longitudinal edges extending parallel to the longitudinal axis. The channel has tapered edges at about an end thereof that converge to an arcuate funneling region. The second plate overlies the first plate such that the funneling region extends along an edge of the vacuum opening. A fluid jet device having the maintenance module mounted thereto is also disclosed.

20 Claims, 1 Drawing Sheet

MAINTENANCE MODULE FOR FLUID JET DEVICE

BACKGROUND OF THE INVENTION

The present invention relates generally to fluid jet devices. More particularly, the present invention pertains to fluid jet devices, such as ink jet print systems and maintenance modules configured for mounting to an ink jet print system print head.

Fluid jet devices are in wide spread use. One particular use for such a device is in ink jet printers. There are a number of principle types of ink jet printers. One type of printer relies upon capillary action to move a working fluid (e.g., ink) to the print head. The ink is directed from the print head through one or more orifices toward a target substrate. Ink jet printers include an actuator for urging the ink through the orifice. Actuators can include piezzo electric elements, thermal devices and the like. An exemplary ink jet print head is disclosed in DeYoung et al., U.S. Pat. No. 4,418,355.

Typically, the print head includes a fluid passageway or chamber configured for ink flow from a source to the actuator, and through the orifices. During normal operation of the print head, ink is present in the passageway or chamber. Actuation of the actuator draws ink into the passageway through the actuator and out through the orifices. It has, however, been found that air, which can enter the fluid chamber (through the orifices) or dirt or debris that can become lodged in the orifices, results in improper operation of the fluid jet device. Air and debris can result in reduced ink drawn into the flow passageway and subsequently cause the failure to eject ink through the orifices. Thus, it has been found that for effective operation of the print head, the ink flow passageway or chamber must be devoid of air and dirt or debris and that the passageway must remain filled with ink.

A number of devices, configurations and methods have been proposed and are used to prevent improper operation of the print head either by preventing air entrainment in the ink or by preventing debris from gathering at the orifices. Some of these configurations and methods are directed to preventing the entrainment of air and collection of debris, while other configurations and methods are directed to mitigating the effects of air entrainment and debris. Still others are directed to removing air that may have already been entrained in the system, or by removing debris that may have already collected at the orifices.

It has, however, been found that many such "maintenance" designs require complex arrangements of plates, fluid (e.g., air) supplies, vacuum lines and the like external to the print head. Although many of these configurations and methods have been found to be effective, their complexity increases the cost of the overall system, as well as the opportunity for equipment failure because of design and component complexity.

Accordingly, there exists a need for a maintenance module for a fluid jet device having a straight-forward and simple design. Most desirably, such a maintenance module facilitates the collection of purge fluid from the fluid jet device used to entrained air and debris that may have collected on the jet device. Most desirably, such a maintenance module incorporates provisions for drawing a vacuum at the fluid jet device to remove fluid that may have been ejected from the device during the purge cycle.

BRIEF SUMMARY OF THE INVENTION

A maintenance module is mounted to the front of a fluid jet device to facilitate maintaining the front of the device in a clean state. The module includes first and second plates affixed to one another. The plates define a longitudinal axis and a transverse axis perpendicular to the longitudinal axis.

The first or rear plate is a chamber plate/orifice plate that overlies the fluid chamber of the fluid jet device. The first plate has a plurality of orifices formed therein. In a present embodiment, the first plate has to parallel rows of closely spaced orifices. The orifices extend parallel to the longitudinal axis inwardly of longitudinal edges of the plate.

The first plate includes a vacuum opening formed therein at about a transverse edge of the first plate. The vacuum opening is preferably formed along the longitudinal axis and extends into the plate, perpendicular to a plane defined by the longitudinal and transverse axes. In a current embodiment, the vacuum opening has inwardly tapered walls.

To mount the module to the fluid jet device, the first plate can include a plurality of mounting openings extending along opposing longitudinal edges of the plate inwardly of the edges. The mounting openings are formed parallel to the longitudinal axis and spaced outwardly of the orifices. The first plate can include a flange extending about a periphery thereof.

The second plate is affixed to and preferably bonded to the first plate. The second plate has an elongated channel therein extending over the first plate orifices so that the orifices are exposed through the elongated channel. The channel is defined by opposing longitudinal edges extending parallel to the longitudinal axis and preferably formed symmetrically about the longitudinal axis.

The channel has tapered edges at about an end thereof. The tapered edges converge to an arcuate funneling region. The second plate overlies the first plate such that the funneling region extends along an edge of the vacuum opening. In a current embodiment, the second plate includes a plurality of fastener openings that correspond to an d align over the first plate mounting openings.

To facilitate properly aligning the module on the fluid jet device, the maintenance module can include orienting notches formed in the first and second plates that align with one another. In a present embodiment, orienting notch is formed through the first plate up to but exclusive of the flange.

The maintenance module can be formed with the second plate having a polymer coating thereon. The coating facilitates maintaining the plate in a clean condition.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
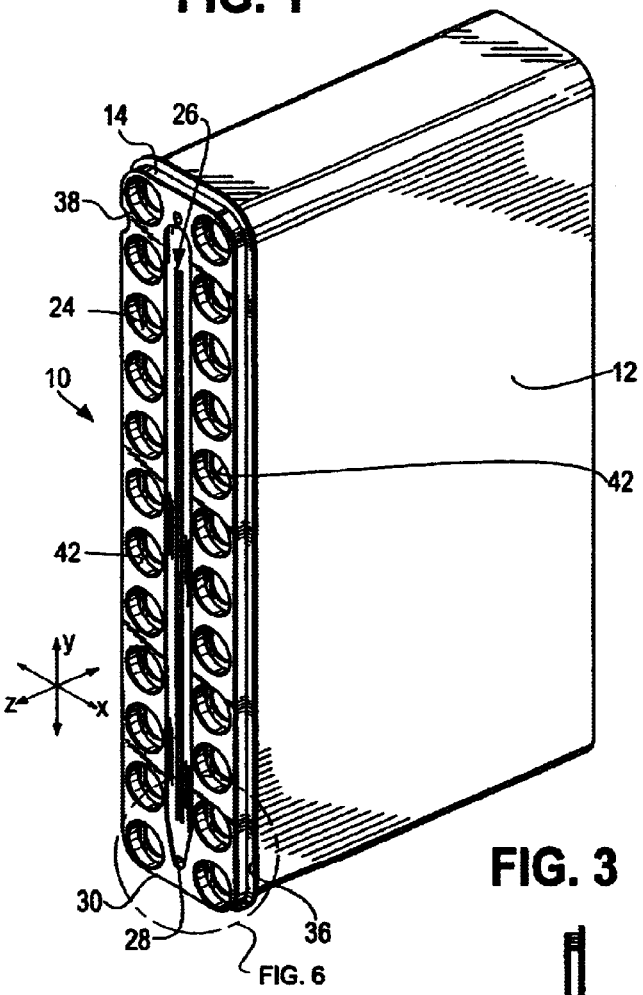
FIG. 1 is a perspective view of an exemplary print head having a maintenance module embodying the principles of the present invention mounted thereto.
Figure 2:
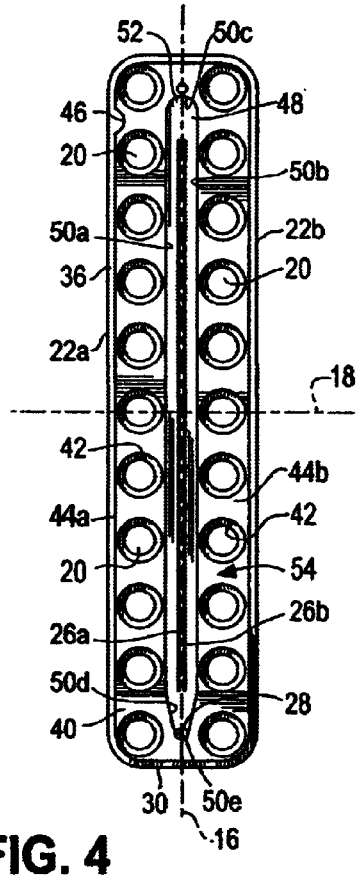
FIG. 2 is front view of the maintenance module of FIG. 1.
Figure 3:
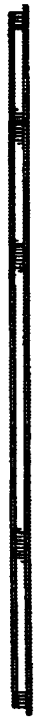
FIG. 3 is a right-hand side view of the maintenance module.
Figure 4:
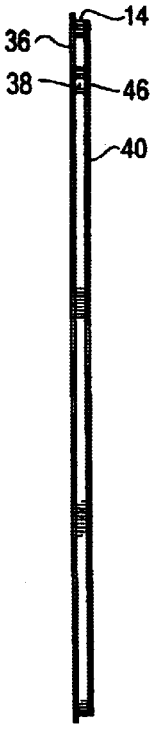
FIG. 4 is a left-hand side view of the maintenance module.
Figure 5:
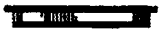
FIG. 5 is a top view of the maintenance module.

While the present invention is susceptible of embodiment in various forms is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

All patents referred to herein, are hereby incorporated herein by reference, whether or not specifically do so within the text of this disclosure.

In the present disclosure, the words "a" or "an" are to be taken to include both the singular and the plural. Conversely, any reference to plural items shall where appropriate, include the singular.

Referring now to the figures and in particular to FIG. 1, there is shown a maintenance module 10 mounted to an exemplary fluid jet device 12, such as the illustrated print head. Although the present invention is presented with reference to print head or inkjet device, those skilled in the art will recognize that the present maintenance module 10 can be used with any fluid jet device 12, including inkjet ink jet print heads, adhesive jetting devices and the like, without limitation. As set forth above, the print head 12 includes a plurality of actuators (not shown) that, upon actuation, eject or push a fluid therefrom. The fluid exits the device through a pluarility of orifices on a front plate (not shown).

The maintenance module 10 is mounted to the front of the fluid jet device 12. The maintenance module 10 includes a rear plate 14 referred to as a chamber plate/orifice plate. The rear plate 14 is an elongated member that defines a major axis (or longitudinal axis) 16 and a minor axis (or transverse axis) 18. The rear plate includes a plurality of mounting the holes 20 extending adjacent and parallel to each of the elongated edges 22*a,b* of the plate 14, parallel to the major axis 16. The mounting holes 20 are counter-bored or tapered, as indicated at 24, to permit mounting the maintenance module 10 to the fluid jet device 12 so that the fasteners (not shown) that are used to mount the module 10 are flush (or recessed) relative to the module 10.

The plate 14 includes a plurality of orifices 26 formed longitudinally along the plate 14 generally at a center thereof. In a present embodiment, two parallel rows of orifices 26*a,b* are formed in the plate 14 parallel to the longitudinal axis 16. The orifices 26*a,b* provide a flow path for fluid that is ejected from the actuators onto the substrate.

The rear plate 14 includes a vacuum opening 28 formed therein at about, and inwardly of one of the minor or transverse edges 30. The vacuum opening 28 is formed inwardly of the edge 30, between the major or longitudinal edges 22*a,b* (essentially along the longitudinal axis 16). In a preferred embodiment, the vacuum opening 28 is formed having a chamfered or tapered edge, as indicated 32. That is, the angle formed between the rear plate surface 34 and the opening 28 is less than 90 degrees (eliminating a sharp angle at the edge).

The rear plate 14 further includes a rear or mounting flange 36. In a present embodiment, the flange 36 is formed as part of or integral with the rear plate 14. In the present embodiment, the rear plate 14 is formed from a rigid material, such as a metal to provide structural integrity and strength to the module 10. A notch 38 can be formed in the rear plate 14, along one of the major edges 22*a*. The notch 38 facilitates properly orienting the module 10 on the print head 12. In a current embodiment, the notch 38 extends through a front portion of the plate 14, but does not extend into the rear flange 36.

The maintenance module 10 includes a maintenance plate or front plate 40 mounted to the rear plate 14. The maintenance plate 40 includes a plurality of fastener openings 42 extending inwardly of and parallel to longitudinal edges 44*a,b* of the plate 40. The maintenance plate fastener openings 42 correspond to the rear plate mounting openings 20. In that the maintenance plate 40 is a relatively thin member (presently about 10 mils or $^{10}/_{1000}$ inch thick), the fastener openings 42 are through-openings, rather than counter-bored. This also facilitates flush (or a low surface) mounting of the fasteners (not shown) that are used to mount the maintenance module 10 to the fluid jet head 12. The maintenance plate 40 can include a notch 46 that corresponds to the rear plate notch 38. Again, this notch 46 is used to assure properly orienting the module 10 on the print head 12.

An elongated central channel 48 is formed in the maintenance plate 40. The central channel 48 is formed interior of (between) the fastener openings 42 and extends longitudinally along the maintenance plate 40 to fully expose the rear plate orifices 26. In a current embodiment, the channel 48 is formed by a pair of generally parallel and spaced edges 50*a,b* that, at one end (as indicated at 50*c*), are joined by a semi-circular edge 52 and at an opposing end (as indicated at 50*d*, overlying the vacuum opening 28), taper toward one another, terminating at an arcuate central region 50*e*. The arcuate central region 50*e* defines a funneling region that terminates over the vacuum opening 28 in the rear plate 14. It has been found that the channel edge tapers (at 50*d*) facilitate directing fluid that is expelled from the orifices 26 but is not jetted on to a substrate. For example, it has been found that the channel edges 50*a,b*, the taper 50*d* and the funneling region 50*e* help to direct fluid (e.g., ink) to the vacuum opening 28 when ink drips from the orifices 26 or if ink is expelled from the orifices 26 during, for example, a purge or priming cycle.

Figure 6:
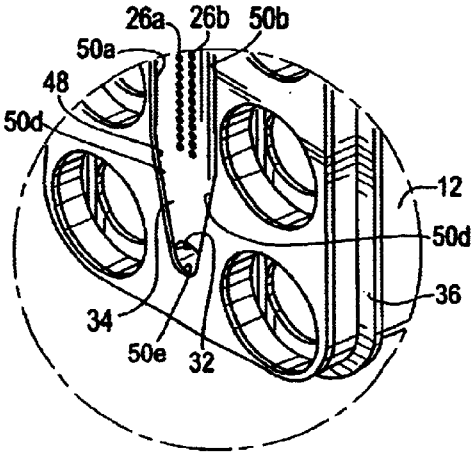
FIG. 6 is a partial view of the lower portion of the maintenance module shown the circled region of FIG. 1.

Referring briefly to FIG. 6, the various tapers (in the maintenance plate channel 50*d,e* and the chamber plate/orifice plate vacuum opening as at 32) will be described with reference to the x-axis oriented parallel to the rear plate transverse or minor axis 18, the y-axis oriented parallel to the rear plate longitudinal or major axis 16 and the z-axis oriented perpendicular to the plate 14, into the plane defined by the x- and y-axes. The maintenance plate channel edges as at 50*d* taper inwardly (toward one another) in the y-axis direction whereas the rear plate vacuum opening edges as at 32 taper inwardly in the z-axis direction. This multi-directional taper has been found to facilitate directing fluid that is in the channel 48 toward and into the vacuum opening 28, rather than merely accumulating at the base of the channel 48 in the tapered region (as at 50*d*). It has been observed that this greatly facilitates the removal or vacuuming away of any fluid that may drip down the front of the chamber plate/orifice plate 14 within the maintenance plate channel 48.

As set forth above, the maintenance plate 40 is formed from a metal, preferably, a stainless steel. However, the plate 40 is a relatively thin element. To this end, the maintenance plate 40 is preferably bonded to the rear plate 14 by, for example, an adhesive. The adhesive should be applied so as to prevent exposure of the adhesive within or near any of the orifices 26. It has also been found that a coating (as indicated at 54) can be applied to the outer surface of the maintenance plate 40. For example, a coating 54 of a fluoropolymer resin, such as TEFLON ® can be applied to the maintenance plate 40 to facilitate cleaning the plate, 40 and maintain the plate 40 free of debris.

Although the present fluid jet device 12 and maintenance module 10 are shown in a vertical orientation (that is, with the longitudinal axis 16 vertical), those skilled in the art will recognize that the present module 10 can be configured for mounting to a jet device that is oriented horizontally or at an angle between the vertical and the horizontal, without departing from the scope and spirit of the present invention.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A maintenance module for a fluid jet device, comprising:

a first plate defining a longitudinal axis and a transverse axis perpendicular to the longitudinal axis, the plate having a plurality of orifices formed therein extending parallel to the longitudinal axis inwardly of longitudinal edges of the first plate, the first plate including a vacuum opening formed therein at about a transverse edge of the first plate, the vacuum opening formed perpendicular to a plane defined by the longitudinal and transverse axes; and a second plate affixed to the first plate, the second plate defining a longitudinal axis and a transverse axis perpendicular to the longitudinal axis the second plate having an elongated channel therein extending over the first plate orifices so that the orifices are exposed through the elongated channel, the channel defined by opposing longitudinal edges extending parallel to the longitudinal axis, the channel having tapered edges at about an end thereof converging to an arcuate funneling region, the second plate overlying the first plate such that the funneling region extends along an edge of the vacuum opening.

2. The maintenance module in accordance with claim 1 wherein the plurality of orifices formed in the first plate are disposed in two parallel rows.

3. The maintenance module in accordance with claim 1 wherein the vacuum opening is formed on the longitudinal axis and wherein the channel is formed symmetrically about the longitudinal axis.

4. The maintenance module in accordance with claim 1 wherein the first plate includes a plurality of mounting openings formed therein, the mounting openings extending along opposing longitudinal edges of the plate, parallel to the longitudinal axis and outwardly spaced from the orifices.

5. The maintenance module in accordance with claim 4 wherein the mounting openings are counter-bored.

6. The maintenance module in accordance with claim 4 wherein the second plate includes a plurality of fastener openings corresponding to and aligning over the first plate mounting openings.

7. The maintenance module in accordance with claim 1 wherein the vacuum opening is formed having inwardly tapered walls.

8. The maintenance module in accordance with claim 1 including an orienting notch formed in the second plate and an orienting notch formed partially through the first plate, the notches aligning with one another.

9. The maintenance module in accordance with claim 1 wherein the first plate includes a flange extending about a periphery thereof.

10. The maintenance module in accordance with claim 1 wherein the second plate has a polymer coating thereon.

11. The maintenance module in accordance with claim 1 wherein the second plate is bonded to the first plate.

12. A maintenance module for a fluid jet device, comprising:

a first plate defining a longitudinal axis and a transverse axis perpendicular to the longitudinal axis, the plate having a plurality of orifices formed therein in at least one row, the orifices extending parallel to the longitudinal axis inwardly of longitudinal edges of the first plate centrally thereof, the first plate including a vacuum opening formed therein at about a transverse edge of the first plate, the vacuum opening formed along the longitudinal axis and formed perpendicular to a plane defined by the longitudinal and transverse axes, the vacuum opening having inwardly tapered walls, the first plate including a plurality of mounting openings extending along opposing longitudinal edges of the plate inwardly of the edges, the mounting openings formed parallel to the longitudinal axis and spaced outwardly of the orifices, the first plate including a flange extending about a periphery thereof; and a second plate bonded to the first plate, the second plate defining a longitudinal axis and a transverse axis perpendicular to the longitudinal axis, the second plate having an elongated channel therein extending over the first plate orifices so that the orifices are exposed through the elongated channel, the channel defined by opposing longitudinal edges extending parallel to the longitudinal axis and formed symmetrically about the longitudinal axis, the channel having tapered edges at about an end thereof converging to an arcuate funneling region, the second plate overlying the first plate such that the funneling region extends along an edge of the vacuum opening, the second plate including a plurality of fastener openings corresponding to and aligning over the first plate mounting openings.

13. The maintenance module in accordance with claim 12 wherein the plurality of orifices formed in the first plate are disposed in two parallel rows.

14. The maintenance module in accordance with claim 12 including an orienting notch formed in the second plate and an orienting notch formed through the first plate up to but exclusive of the flange, the notches aligning with one another.

15. The maintenance module in accordance with claim 12 wherein the second plate has a polymer coating thereon.

16. A fluid jet device of the type having a fluid chamber, at least one actuator in fluid communication fluid chamber for providing a motive force for jetting the fluid therefrom, and at least one orifice for jetting fluid from the actuator, the fluid jetting device including a maintenance module mounted thereto to overlie the at least one orifice, comprising:

a first plate defining a longitudinal axis and a transverse axis perpendicular to the longitudinal axis, the plate having a plurality of plate orifices formed therein in at least one row, the plate orifices extending parallel to the longitudinal axis inwardly of longitudinal edges of the first plate centrally thereof, the first plate including a vacuum opening formed therein at about a transverse edge of the first plate, the vacuum opening formed along the longitudinal axis and formed perpendicular to a plane defined by the longitudinal and transverse axes, the vacuum opening having inwardly tapered walls, the first plate including a plurality of mounting openings extending along opposing longitudinal edges of the plate inwardly of the edges, the mounting openings formed parallel to the longitudinal axis and spaced outwardly of the plate orifices, the first plate including a flange extending about a periphery thereof; and a second plate bonded to the first plate, the second plate defining a longitudinal axis and a transverse axis perpendicular to the longitudinal axis, the second plate having an elongated channel therein extending over the plate orifices so that the plate orifices are exposed through the elongated channel, the channel defined by opposing longitudinal edges extending parallel to the longitudinal axis and formed symmetrically about the longitudinal axis, the channel having tapered edges at about an end thereof converging to an arcuate funneling region, the second plate overlying the first plate such that the funneling region extends along an edge of the vacuum opening, the second plate including a plurality of fastener openings corresponding to and aligning over the first plate mounting openings.

17. The fluid jet device in accordance with claim 16 wherein the plurality of orifices formed in the first plate are disposed in two parallel rows.

18. The fluid jet device in accordance with claim 16 including an orienting notch formed in the second plate and an orienting notch formed through the first plate up to but exclusive of the flange, the notches aligning with one another.

19. The fluid jet device in accordance with claim 16 wherein the second plate has a polymer coating thereon.

20. The fluid jet device in accordance with claim 16 wherein the vacuum opening is longitudinally aligned with the plate orifices.

* * * * *